US008813628B2

(12) United States Patent
Isserstedt

(10) Patent No.: US 8,813,628 B2
(45) Date of Patent: Aug. 26, 2014

(54) WEAPON CLEARANCE DEVICE FOR CLEARING WEAPONS UNDER WATER, SUCH AS UNDERWATER MINES, COMBINED WEAPON CLEARANCE DEVICE COMPRISING UNMANNED UNDERWATER VEHICLE AND SUCH A WEAPON CLEARANCE DEVICE AS WELL AS A METHOD THEREFOR

(71) Applicant: Atlas Elektronik GMBH, Bremen (DE)

(72) Inventor: Thorsten Isserstedt, Achim (DE)

(73) Assignee: Atlas Elektronik GmbH (DE)

( * ) Notice: Subject to any disclaimer, the term of this patent is extended or adjusted under 35 U.S.C. 154(b) by 0 days.

(21) Appl. No.: 13/705,789

(22) Filed: Dec. 5, 2012

(65) Prior Publication Data

US 2013/0263725 A1 Oct. 10, 2013

(30) Foreign Application Priority Data

Dec. 21, 2011 (DE) ..... 10 2011 121 856

(51) Int. Cl.

| | |
|---|---|
| ***B64D 1/04*** | (2006.01) |
| ***B63G 7/06*** | (2006.01) |
| ***B63G 7/08*** | (2006.01) |
| ***B63G 7/02*** | (2006.01) |

(52) U.S. Cl.

CPC .. *B63G 7/06* (2013.01); *B63G 7/08* (2013.01); *B63G 7/02* (2013.01)

USPC ..... 89/1.13; 89/5; 114/316; 114/317

(58) Field of Classification Search

USPC ..... 89/1.13, 5, 1.11; 114/316, 317

See application file for complete search history.

(56) References Cited

U.S. PATENT DOCUMENTS

| | | | | |
|---|---|---|---|---|
| 4,972,389 | A * | 11/1990 | Teel | 367/155 |
| 8,502,063 | B1 * | 8/2013 | Rivoli | 114/20.1 |
| 2008/0127876 | A1 * | 6/2008 | Scourzic et al. | 114/316 |

FOREIGN PATENT DOCUMENTS

| | | | |
|---|---|---|---|
| DE | 3626434 | A1 | 2/1988 |
| DE | 3915577 | A1 | 11/1990 |
| DE | 301215 | A7 | 10/1992 |
| DE | 69406029 | T2 | 2/1998 |
| GB | 2234203 | A | 1/1991 |

OTHER PUBLICATIONS

International Search Report from corresponding DE 10 2011 121 856.8 filed Dec. 21, 2011.

* cited by examiner

*Primary Examiner* — J. Woodrow Eldred
(74) *Attorney, Agent, or Firm* — Polster Lieder

(57) ABSTRACT

The disclosure provides a weapon clearance device for clearing weapons by detonating the weapon, a combined weapon clearance device comprising the weapon clearance device and an unmanned underwater vehicle, and a method associated therewith for clearing weapons. The weapon clearance device comprises a retaining device for fixing the weapon clearance device to the weapon or in the surrounding area of the weapon. The weapon clearance device is a driveless attachment for the unmanned underwater vehicle comprising a means for the releasable connection to the unmanned underwater vehicle. The mass of the weapon clearance device under water is invariably less or greater than the mass of the water displaced by the weapon clearance device under water. The weapon clearance device is thus not neutral in terms of buoyancy, which provides advantages when clearing sunk ground mines as well as floating mines by approaching the mine from above and/or from below.

12 Claims, 3 Drawing Sheets

WEAPON CLEARANCE DEVICE FOR CLEARING WEAPONS UNDER WATER, SUCH AS UNDERWATER MINES, COMBINED WEAPON CLEARANCE DEVICE COMPRISING UNMANNED UNDERWATER VEHICLE AND SUCH A WEAPON CLEARANCE DEVICE AS WELL AS A METHOD THEREFOR

CROSS-REFERENCE TO RELATED APPLICATIONS

This application claims the benefit, under 35 U.S.C. §119, of DE 10 2011 121 856.8, filed Dec. 21, 2011, the disclosure of which is incorporated herein by reference in its entirety.

FIELD

The present teachings relate to a weapon clearance device for clearing weapons under water, such as underwater mines or munitions sunk in waterways, by detonating the weapon, as well as a method for clearing weapons by detonating the weapons.

BACKGROUND

The statements in this section merely provide background information related to the present disclosure and can not constitute prior art.

Weapons, such as underwater mines or munitions which have been sunk, are often still located in waterways decades after hostile action. Such weapons represent a potential hazard both for marine navigation and for the environment. There is, therefore, a requirement for efficient, low-cost and safe clearance of such weapons.

It is known to use unmanned underwater vehicles as mine destruction drones and thus as weapon clearance devices for clearing weapons. Such mine destruction drones are fitted with hollow charges with only a small amount of explosives, for example with a mass of one to two kilograms. For mine destruction and/or generally for weapon removal, the mine destruction drone is moved directly adjacent to the object to be destroyed, substantially from one side, and by means of a retaining device fixed to the object or in the region of the object and/or weapon, e.g., the surrounding area of the weapon, then the hollow charge is fired inside the underwater vehicle, the underwater vehicle being detonated together with the object. This method is highly efficient and also only requires a small amount of explosives. However, the method is costly since an underwater vehicle is lost whenever it is used. Additionally, mines which have sunk at least partially into the sea bed are not able to be reached in this manner or only to a limited extent. Also, approaching floating mines from the side is difficult due to waves and swell.

SUMMARY

The object of the invention is to improve and to develop more cost-effectively the clearing of weapons under water, in particular weapons on the sea bed or in the region of the water surface.

The invention achieves this object by means of a weapon clearance device for clearing weapons under water, such as underwater mines or munitions sunk in waterways, by detonating the weapon. The weapon clearance device comprising a retaining device for fixing the weapon clearance device to the weapon or in the region of the weapon, e.g., the surrounding area of the weapon. The weapon clearance device is a driveless attachment for an unmanned underwater vehicle comprising a means for the releasable connection to the unmanned underwater vehicle. The mass of the weapon clearance device being invariably less or greater than the mass of the water displaced by the weapon clearance device under water, in particular both in the case where the weapon clearance device is connected to the unmanned underwater vehicle and also in the case where the weapon clearance device is fixed to the weapon or in the region of the weapon.

In various embodiments, the present disclosure provides the combination of the weapon clearance device and an unmanned underwater vehicle, wherein the weapon clearance device which is able to be attached thereto or is attached thereto.

In various other embodiments, the present disclosure provides a method for clearing weapons under water such as underwater mines or munitions which have sunk in waterways, by detonating the weapon, by utilizing an unmanned underwater vehicle comprising a weapon clearance device attached thereto. In the case where the mass of the weapon clearance device is less than the mass of the water displaced by the weapon clearance device under water, the unmanned underwater vehicle approaches the weapon from below, in particular with the front end raised. Or, in the case where the mass of the weapon clearance device is greater than the mass of the water displaced by the weapon clearance device under water, the unmanned underwater vehicle approaches the weapon from above, in particular with the front end lowered. Subsequently the weapon clearance device is fixed to the weapon or in the region of the weapon, and at the same time or subsequently, the weapon clearance device is released from the unmanned underwater vehicle. In response thereto, the unmanned underwater vehicle again automatically moving away upwards or downwards from the weapon and/or altering its alignment in the water. The unmanned underwater vehicle is moved away from the weapon to a distance which is greater than or the same as a predetermined safety distance, and a clearance charge and/or spoof device of the weapon clearance device is activated in order to detonate the weapon.

The weapon clearance device is configured for clearing weapons underwater by detonating the weapon. Herein, the term "weapons" is understood, for example, as underwater mines, in particular ground mines or floating mines, or munitions sunk in waterways. The weapon clearance device comprises a retaining device for fixing the weapon clearance device to the weapon or in the region of the weapon. The weapon clearance device fixed to the weapon has a fixed position and alignment relative to the weapon. The retaining device for the fixing ensures that the weapon clearance device remains in the correct position and alignment relative to the weapon, even when the weapon clearance device is subjected to water currents. The exact alignment of the weapon clearance device relative to the weapon advantageously permits the use of only small quantities of explosives, which is advantageous relative to safety requirements during the storage and transportation of explosives.

The weapon clearance device is configured as a driveless attachment for an unmanned underwater vehicle and/or such a driveless attachment, in particular for attaching to the front end of the underwater vehicle. In particular, the weapon clearance device does not have a separate drive for maneuvering the weapon clearance device relative to the weapon. The weapon clearance device is not provided as an integral component of an underwater vehicle but merely as an attachment for the unmanned underwater vehicle. The underwater vehicle in this case serves as a transport vehicle for the weapon clearance device which is fixed in the region of the weapon and/or onto the weapon and is released from the underwater vehicle. The weapon clearance device for releasing from the underwater vehicle has a means for the releasable connection to the unmanned underwater vehicle. In this case, the release is not carried out by the underwater vehicle but by the weapon clearance device, using the means for the releasable connection. The weapon clearance device is thus detached from the underwater vehicle in the region of the weapon, so that the underwater vehicle is able to move away from the danger zone before the detonation of the weapon. The underwater vehicle is thus able to be reused after use and thus transport further weapon clearance devices to further weapons so that costs are saved.

The weapon clearance device has a positive or negative buoyancy which is significantly different from zero. The buoyancy of a body under water substantially results from the difference between the buoyancy force of the body and the weight force thereof. The weight force is determined by the mass of the body and acts in the center of mass. The buoyancy force is determined by the volume of the body and acts on the center of volume. A body is neutral in terms of buoyancy and/or has neither a positive nor a negative buoyancy when the mass of the body corresponds to the mass of the water which is displaced by the body and/or by the volume thereof under water.

According to the invention, it is provided that the weapon clearance device is invariably not neutral in terms of buoyancy and/or the mass of the weapon clearance device is, in particular, invariably at least 1% less, or more, than the mass of the water displaced by the weapon clearance device under water. This applies, in particular, both in the case where the weapon clearance device is connected to the unmanned underwater vehicle and in the case where the weapon clearance device is fixed to the weapon or in the region of the weapon. The weapon clearance device thus does not need to have any devices for altering the buoyancy. After the weapon clearance device is fixed to the weapon or in the region of the weapon, the buoyancy of the weapon clearance device is largely irrelevant.

Attached to the underwater vehicle, however, the weapon clearance device advantageously influences the alignment of the underwater vehicle in the water and thus permits the weapon to be approached from a direction with a significant vertical component, which preferably quantitatively exceeds a horizontal component of this direction.

In particular, when the unmanned underwater vehicle with the weapon clearance device approaches the weapon, the positive or negative buoyancy of the weapon clearance device ensures that such an advantageous approach to the weapon is possible from above or below. It can be assumed therefrom that when the weapon clearance device has a positive buoyancy, the unmanned underwater vehicle has at least a lower positive buoyancy or is configured to be neutral in terms of buoyancy, or even has a negative buoyancy, so that both a combined weapon clearance device comprising the unmanned underwater vehicle and the weapon clearance device, and the unmanned underwater vehicle after separation from the weapon clearance device, are located in the water in a manner in which they can be controlled in a stable manner. As a result, an overturning moment and/or aligning moment is produced about the transverse axis in the combined weapon clearance device, which is able to be counteracted by a control means when the combined weapon clearance device moves and which permits the weapon to be approached even when the combined weapon clearance device moves slowly with the front end raised or lowered.

The aligning moment is produced by means of the weight force and the buoyancy force when the center of gravity of the volume and center of gravity of the mass of a body are not identical. The aligning moment aims to align the body such that the center of gravity of the volume is arranged above the center of gravity of the mass. The invention makes use of this recognition in order to produce an overturning moment of the combined weapon clearance device about the transverse axis as a result of the weapon clearance device not being configured to be neutral in terms of buoyancy when attached to an unmanned underwater vehicle, which has a different buoyancy from the weapon clearance device and is preferably adjusted to be neutral in terms of buoyancy, and the overturning moment is altered relative to a possible overturning moment in the unmanned underwater vehicle without the weapon clearance device.

In this manner, the weapon clearance device according to the invention can approach a weapon sunk into the sea bed from above, for example, in particular a ground mine and can be fixed to the weapon when the weapon clearance device has a negative buoyancy and/or when the mass of the weapon clearance device is greater than the mass of the water displaced by the weapon clearance device.

When, in contrast, the mass of the weapon clearance device is less than the mass of the water displaced by the weapon clearance device under water and/or when the weapon clearance device has a positive buoyancy, the combined weapon clearance device can advantageously approach a weapon floating on the surface of the water or in the vicinity of the surface of the water, in particular a floating mine, from below and the weapon clearance device can advantageously be fixed to the weapon.

Due to the resulting exact positioning of the explosive charge thereby, a small quantity of explosives is sufficient in order to destroy the weapon. Small quantities of explosives, moreover, permit the use of small underwater vehicles, whereby the costs of using weapon clearance devices can be kept low.

According to various methods of the present disclosure, it is provided that an unmanned underwater vehicle with the weapon clearance device according to the invention attached thereto approaches a weapon. In the case where the mass of the weapon clearance device is less than the mass of the water displaced by the weapon clearance device under water, the unmanned underwater vehicle approaches the weapon from below. And, in the case where the mass of the weapon clearance device is greater than the mass of the water displaced by the weapon clearance device under water, the unmanned underwater vehicle approaches the weapon from above. The phrase "approach from below" is understood to be, an approach with, in particular, the front end of the weapon clearance device raised by at least 45° relative to the horizontal, and the unmanned underwater vehicle during the approach reducing its depth in the water. The phrase "approach from above" is understood to be an approach with the front end of the underwater vehicle lowered, in particular, by at least 45° relative to the horizontal, and the unmanned underwater vehicle during this approach increasing its depth in the water. The advantageous positioning of the weapon clearance device on the weapon is possible due to the approach from below and/or above. When the drive of the underwater vehicle malfunctions or, for example, threatens to malfunction due to a flat battery, the clearance of the mine is interrupted so that the underwater vehicle is ultimately salvaged without the prior fixing of the weapon clearance device to the weapon or in the region of the weapon.

If, however, the underwater vehicle with the weapon clearance device successfully reaches the weapon, the weapon clearance device is subsequently fixed to the weapon or in the region of the weapon. In this case, it is possible to position and fix the weapon clearance device in an accurate and targeted manner by means of the approach controlled by the underwater vehicle. At the same time as the fixing or subsequently thereto, the weapon clearance device is released from the unmanned underwater vehicle. A simultaneous release of the weapon clearance device from the unmanned underwater vehicle, or one which takes place as soon as possible, has the advantage that the unmanned underwater vehicle does not remain fixed to the weapon by means of the weapon clearance device, or only for a short period of time, and thus remains controllable and/or after fixing is rapidly able to be actively controlled again.

In response to the release of the weapon clearance device from the unmanned underwater vehicle, the unmanned underwater vehicle moves again automatically upwards or downwards away from the weapon and/or alters its alignment in the water relative to its transverse axis. In this case, the automatic removal can be carried out by a positive or negative buoyancy of the underwater vehicle and, alternatively or in addition, by altering the alignment in the water and/or by an aligning moment on the unmanned underwater vehicle about its transverse axis.

The automatic removal upwards can be carried out by a positive buoyancy and, alternatively or in addition, by an aligning moment on the unmanned underwater vehicle forcing the underwater vehicle, for example, into the horizontal. The automatic removal downwards from the weapon can accordingly be carried out by a negative buoyancy and, alternatively or in addition, by an aligning moment which lowers the front end of the unmanned underwater vehicle and/or horizontally aligns the underwater vehicle. Thus the separation of the unmanned underwater vehicle from the weapon clearance device is carried out due to the positive or negative buoyancy of the weapon clearance device and/or due to the aligning moment acting about the transverse axis, such that a minimum distance is rapidly created between the weapon clearance device and the underwater vehicle and/or the front end of the underwater vehicle, which represents an optimal starting position in order to move the unmanned underwater vehicle subsequently, in particular by a separate drive, to a distance away from the weapon. This distance is a distance which is greater than or the same as a predetermined safety distance. Only then is a clearance charge and/or a spoof device of the weapon clearance device activated in order to detonate the weapon. The weapon clearance device is thus destroyed. The unmanned underwater vehicle, however, can be reused.

According to various embodiments of the weapon clearance device, the weapon clearance device comprises one or more clearance charges with directional effect, in particular one or more hollow charges, and a firing device for firing the clearance charge and/or clearance charges. The use of clearance charges with a directional effect increases the efficiency of the explosives used. The quantity of explosives positioned on the weapon clearance device can thus be relatively small so that the weapon clearance device and the unmanned underwater vehicle can also be of correspondingly small dimensions. Also, only low safety requirements are necessary during the transportation and storage of the weapon clearance device onboard the mother ship.

According to further embodiments, the weapon clearance device alternatively or additionally comprises a spoof device for simulating properties of a ship or submarine. Preferably, the spoof devices acoustically or magnetically simulate the presence of a ship or submarine in order to move a mine for detonation, the mine detecting the presence of a ship or submarine by means of acoustic or magnetic sensors. In this manner, the weapon can be cleared by means of the spoof device even without the use of additional explosives. The spoof device, therefore, preferably comprises a means for producing noise from a ship and/or submarine and/or a means for producing a magnetic field. By the production of an artificial magnetic field, a magnetic field sensor in the firing mechanism of an underwater mine can be stimulated such that it causes the underwater mine to be detonated.

According to other embodiments, the weapon clearance device comprises a means for activating the firing device and/or the spoof device. Thus, a simple activation of the weapon clearance device is possible in order to cause the weapon to be detonated.

The means for activating the firing device and/or the spoof device according to a specific embodiment comprises a radio beacon which can be released from the weapon clearance device for receiving an activation signal via a radio link. The radio beacon rises to the surface of the water after fixing the weapon clearance device to the weapon and/or in the region of the weapon, but remains connected to the weapon clearance device via a cable, and thus permits a communication with the mother ship and/or a control platform via a radio link between the radio beacon and the mother ship, via the radio beacon and via the cable to the weapon clearance device. Thus, the activation signal can easily be transmitted over a large distance to the weapon clearance device, even large safety distances being able to be easily maintained.

According to further embodiments, the means for activating the firing device and/or the spoof device alternatively or additionally comprises an electroacoustic transducer for receiving an activation signal via an acoustic channel. Via the acoustic channel and/or by a means of waterborne sound, the activation signal can be transmitted cost effectively and received by the weapon clearance device.

According to further embodiments, the means for activating the firing device and/or the spoof device alternatively or additionally comprises a firing cable for receiving an activation signal, via the firing cable, by a means of the firing cable a robust and/or option which is less liable to malfunction, for transmitting the activation signal, in particular over short distances, is provided.

Finally, the means for activating the firing device and/or the spoof device according to a further embodiments, alternatively or additionally comprises a timed firing mechanism, which is preferably already activated before the weapon clearance device is deposited by the unmanned underwater vehicle, or is activated when depositing and/or by depositing and/or when fixing to the weapon and/or in response thereto and represents a very cost-effective variant for activating the firing device and/or the spoof device. The timed firing mechanism is used, in particular, when it is ensured that at the moment of firing no danger to humans and devices is to be anticipated in the detonation area.

According to various embodiments, the retaining device comprises a nail firing device. In this case, the weapon clearance device is fixed by means of a nail to the mine or to an object in the region of the mine. The nail is driven into the weapon and/or into the object in the region of the weapon by means of a cartridge firing device, so that the weapon clearance device is subsequently securely fixed.

According to further embodiments, the retaining device alternatively or additionally comprises an electromagnet and/or a vacuum device and/or a clamping device for clamping to the weapon and/or parts thereof and/or objects in the region of the weapon. The electromagnet permits an electromagnetic fixing of the weapon clearance device. The vacuum device permits the fixing by maintaining a vacuum in a region applied to the weapon. The clamping device ensures a mechanical connection and/or fixing of the weapon clearance device to the weapon. A provision of the electromagnet and/or the vacuum device and/or the clamping device in addition to the nail firing device is advantageous in order to permit a fixing of the weapon clearance device if the fixing by means of the nail firing device fails.

The activation of such a retaining device preferably takes place by contact of the weapon clearance device with the weapon. Additionally or alternatively, such an activation takes place by means of metal sensors, which signal that the weapon clearance device is located in the region of the weapon.

The activation of the retaining device thus preferably takes place directly by means of the weapon clearance device, in particular without action from outside and/or without action by the unmanned underwater vehicle. Thus, the weapon clearance device can be used cost-effectively as an attachment for an unmanned underwater vehicle of conventional type.

According to further embodiments, the means for the releasable connection of the weapon clearance device to an unmanned underwater vehicle and the retaining device are configured such that the means for the releasable connection are actuated simultaneously when activating the retaining device for fixing the weapon clearance device to the weapon or in the region of the weapon so that a mechanical connection of the weapon clearance device to the unmanned underwater vehicle is released.

Such a simultaneous fastening of the weapon clearance device to the weapon and/or in the region of the weapon and separating the weapon clearance device from the unmanned underwater vehicle permits the use of conventional unmanned underwater vehicles, in particular mine destruction drones of conventional design, without the construction thereof having to be altered. Instead, the weapon clearance device is easily fastened to the underwater vehicle. Preferably, the weapon clearance device in this case is fastened to the front end of the underwater vehicle.

According to various embodiments, the means for the releasable connection of the weapon clearance device as well as the retaining device are additionally configured such that they can even be actuated independently of an activation of the retaining device, in order to release the weapon clearance device from the unmanned underwater vehicle. Such an independent separation of the weapon clearance device from the underwater vehicle has the advantage that the weapon clearance device can be discarded when the current use has been terminated and/or when the release of the retaining means has not resulted in the fixing of the weapon clearance device to the weapon. The weapon clearance device in this case floats when it has a positive buoyancy, and can be cleared, or in the case of a negative buoyancy sinks to the sea bed, so that at least the danger to marine navigation is minimized. In combination with the timed firing mechanism, it is possible to activate the timed firing mechanism before or when discarding the weapon clearance device from the underwater vehicle, so that the weapon clearance device is automatically detonated after a time period in which the underwater vehicle has been moved to a safe distance and/or in which the weapon clearance device has sunk to the sea bed. In any case, the underwater vehicle can be salvaged and reused after the deposit of the weapon clearance device.

According to various embodiments, the weapon clearance device is configured such that the center of gravity of the mass of the weapon clearance device is displaced relative to the center of gravity of the volume of the weapon clearance device in the active direction of the retaining device, in particular a corresponding displacement vector has at least one component in the active direction with a positive figure which is different from zero. In the case where the retaining device comprises the nail firing device, the active direction of the retaining device is, in particular, the firing direction of the nail firing device. Such a mass distribution in the volume of the weapon clearance device has the advantage that in the case where the weapon clearance device floats due to the positive buoyancy on the surface of the water, the active direction of the retaining device in the vertical direction faces downwards, so that even in the event of a collision of the weapon clearance device, for example with a ship, the weapon clearance device is not fixed to the ship. In particular, therefore, a release of the nail firing device in the direction of the stern of a ship is counteracted so that the safety of the marine traffic is increased relative to any weapon clearance device floating in the water.

In the case of a negative buoyancy of the weapon clearance device, the weapon clearance device sinks to the sea bed, the retaining device, in particular the nail firing device, being potentially activated upon contact with the sea bed which can lead to a fixing of the weapon clearance device to the sea bed. If necessary, the optionally present timed firing mechanism is activated together with the activation of the retaining device so that after a predetermined time period the weapon clearance device is automatically destroyed on the sea bed.

According to various embodiments, the center of gravity of the mass of the weapon clearance device relative to the center of gravity of the volume of the weapon clearance device is displaced to the side of the weapon clearance device and which, in the case where the weapon clearance device is attached to the unmanned underwater vehicle, is remote from the center of gravity of the mass and/or center of gravity of the volume of the underwater vehicle. In particular, the weapon clearance device is attached to the front end of the unmanned underwater vehicle, the side of the weapon clearance device in which the center of gravity of the mass of the weapon clearance device is displaced relative to the center of gravity of its volume being a front end of the weapon clearance device and facing away from the front end of the unmanned underwater vehicle.

This configuration of the weapon clearance device, in particular when the weapon clearance device has a positive and/or greater buoyancy than the unmanned underwater vehicle, has the advantage that an overturning moment which raises the front end of the combined weapon clearance device is lower than if the center of gravity of the mass and the center of gravity of the volume of the weapon clearance device were identical. In particular, in this manner, in a combined weapon clearance device the displacement of the center of gravity of the volume and the center of gravity of the mass from one another by the positive buoyancy of the weapon clearance device, is comparatively less. The mass distribution on the weapon clearance device thus produces an overturning moment which counteracts an overturning moment on the unmanned underwater vehicle. As a result, the combined weapon clearance device is located in a more stable manner in the water and is able to be maneuvered in the water using less energy.

Preferably, the active direction of the retaining device is remote from the center of gravity of the mass of the underwater vehicle, so that the retaining device acts in the direction of the front end of the weapon clearance device and at the same time this results in the advantages of a reduced active direction when the weapon clearance device operates in water without the underwater vehicle and the stabilizing influence on the movement of the combined weapon clearance device. The unmanned underwater vehicle in this case can move towards the front of the weapon to be cleared, the retaining device, in particular the nail firing device, being triggered by contact of the weapon clearance device with the weapon.

According to various embodiments of the combined weapon clearance device, in which the mass of the weapon clearance device is greater than the mass of the water displaced by the weapon clearance device under water, the mass of the combined weapon clearance device is also greater than the mass of the water displaced by the combined weapon clearance device under water. In this case, however, the mass of the underwater vehicle is less than the mass of the water displaced by the underwater vehicle under water. Thus, the weapon clearance device has a negative buoyancy, the underwater vehicle has a positive buoyancy and the combined weapon clearance device with the underwater vehicle and the weapon clearance device has a negative buoyancy. When, therefore, the combined weapon clearance device is not able to be retained by means of the drive of the underwater vehicle at a specific water depth, the combined weapon clearance device sinks automatically and/or of its own accord to the sea bed, and by contact with the sea bed the retaining device being released there and the weapon clearance device being deposited by the underwater vehicle, so that the weapon clearance device remains on the sea bed and is possibly detonated there and/or is automatically detonated and the underwater vehicle floats again to the surface of the water and can be salvaged there.

An interruption to the method for clearing weapons can be caused by a battery of the underwater vehicle threatening to be flat and/or being flat and the underwater vehicle therefore no longer being able to be maneuvered, or only to a limited degree. An interruption of the method can also be caused by the fixing to a weapon failing, in particular the nail firing device having been released, without the weapon clearance device having been fixed to the weapon.

According to various embodiments of the method for clearing weapons, in the case where the clearance is interrupted before the weapon clearance device is fixed to the weapon or in the region of the weapon, the unmanned underwater vehicle automatically sinks with the weapon clearance device attached thereto, as the mass of the underwater vehicle together with the mass of the weapon clearance device is greater than the mass of the water displaced by the underwater vehicle together with the weapon clearance device under water. Subsequently, the weapon clearance device is released at the bottom of the body of water from the unmanned underwater vehicle, in particular automatically, in response to ground contact of the weapon clearance device. Subsequently, the unmanned underwater vehicle automatically rises to the water surface, as the mass of the unmanned underwater vehicle is less than the mass of the water displaced by the unmanned underwater vehicle under water. The center of gravity of the mass of the unmanned underwater vehicle is preferably arranged below the center of gravity of its volume such that the underwater vehicle is not rotated about its longitudinal axis but is located in a stable manner in the water relative thereto.

According to other embodiments of the method, in the case where the method is interrupted before the weapon clearance device is fixed to the weapon or in the region of the weapon, the weapon clearance device attached to the underwater vehicle is released from the unmanned underwater vehicle and subsequently both the weapon clearance device and the unmanned underwater vehicle float to the surface of the water separately from one another, as both have a positive buoyancy. In this case, the weapon clearance device preferably floats in an alignment with a reduced active direction of the retaining device on the surface of the water, so that the risk of fixing the weapon clearance device to an object floating or moving on the surface of the water and/or to a ship is minimized. The weapon clearance device can be cleared and the underwater vehicle salvaged.

Further areas of applicability of the present teachings will become apparent from the description and claims provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

Corresponding reference numerals indicate corresponding parts throughout the several views of drawings.

DETAILED DESCRIPTION

Figure 1:
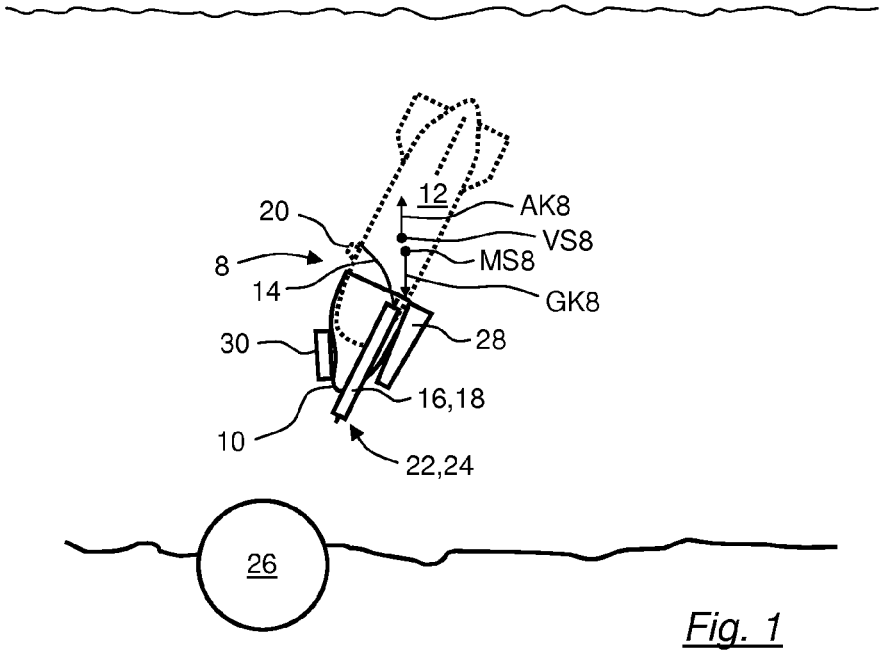
FIG. 1 shows an unmanned underwater vehicle with a weapon clearance device attached thereto according to various embodiments of the present disclosure when approaching an underwater mine sunk at the bottom of the body of water.

The following description is merely exemplary in nature and is in no way intended to limit the present teachings, application, or uses. Throughout this specification, like reference numerals will be used to refer to like elements.

FIG. 1 shows a combined weapon clearance device 8 comprising a weapon clearance device 10 and an unmanned underwater vehicle 12. The weapon clearance device 10 is configured as an attachment for the unmanned underwater vehicle 12 and releasably fastened to the underwater vehicle 12.

The weapon clearance device 10 is configured in the manner of a cap which is slipped over the front end of the unmanned underwater vehicle 12. The weapon clearance device 10 is, therefore, arranged releasably fastened to the front end of the unmanned underwater vehicle 12 and in this case is fixed by means of a fastening means 14 which is configured as an elastic strap 14 to the unmanned underwater vehicle 12. Both ends of the elastic strap 14 in each case act on opposing integral units 16 and 18 for providing means for releasably connecting the weapon clearance device 10 to the underwater vehicle 12. A central portion of the elastic strap 14 engages behind a projection 20 on the unmanned underwater vehicle 12 so that the weapon clearance device 10 is retained by means of the elastic strap 14 on the front end of the underwater vehicle 12.

Due to the elasticity of the strap 14, the weapon clearance device 10 is pulled and/or pushed in the manner of a cap onto the front end of the unmanned underwater vehicle 12 and thus fixed to the front end. This attachment of the weapon clearance device 10 to the underwater vehicle 12, however, is releasable. To release the mechanical connection of the weapon clearance device 10 and the unmanned underwater vehicle 12, the elastic strap 14 is released from the integral units 16 and 18. In this case, the connection between the weapon clearance device 10 and the underwater vehicle 12 is released and the underwater vehicle 10 is able to move away from the weapon clearance device 12.

The integral units 16 and 18 also have in each case a respective retaining device 22 and 24, for fixing the weapon clearance device 10 to a weapon 26, for example a mine, which in this case is shown as a ground mine sunk in the bottom of the body of water. The mine 26 can, however, also be configured in a different manner, for example as an anchor cable mine. Moreover, the invention is not limited to the clearance of mines but also relates to the clearance of munitions.

The retaining devices 22 and 24 are configured as nail firing devices which, in particular in response to contact with the mine 26, drive nails into the mine 26, and by means of the nails fasten the weapon clearance device 10 to the mine 26.

Moreover, one or more hollow charges 28 are provided on the weapon clearance device 10, which in each case form a clearance charge with a directional effect. Preferably the active direction of the hollow charge 28 faces in the same direction as the longitudinal axis of the retaining devices 22 and 24 which, in turn, preferably when the weapon clearance device 10 is fixed to the underwater vehicle 12, extends parallel to the longitudinal axis of the underwater vehicle 12. In this manner, the combined weapon clearance device 8 can be steered forwards with the weapon clearance device 10 on the front end of the underwater vehicle 12 towards a mine 26.

The weapon clearance device 10 further comprises a radio beacon 30 which can be deposited for receiving an activation signal via a radio link to the surface of the body of water.

The combined weapon clearance device 8 shown in FIG. 1 has a negative buoyancy, the weapon clearance device 10 also having a negative buoyancy and the unmanned underwater vehicle 12 in contrast having a positive buoyancy. Where the mass of a body substantially corresponds to the mass of the water displaced by the body under water, the body is denoted in the present case as neutral in terms of buoyancy. In particular, where the mass of a body deviates by a maximum of one percent from the mass of the water displaced by the body under water, the body is denoted as neutral in terms of buoyancy. Bodies which have a lower mass relative thereto have a positive buoyancy, whereas bodies which have a larger mass relative thereto have a negative buoyancy.

A weight force vector GK8 of the combined weapon clearance device 8 faces downwards in the vertical direction and is shown correspondingly longer than a buoyancy vector AK8 facing upwards of the combined weapon clearance device 8. The weight force vector GK8 is a resultant vector which acts in the center of gravity of the mass MS8 of the combined weapon clearance device 8. The buoyancy vector AK8 is a resultant vector which acts in the center of gravity of the volume VS8 of the combined weapon clearance device 8. As long as the center of gravity of the mass MS8 is not arranged in the vertical direction directly below the center of gravity of the volume VS8 or coincides with the center of gravity of the volume VS8, an aligning moment acts on the combined weapon clearance device 8, which aims to bring about this arrangement.

In the view according to FIG. 1, the center of gravity of the mass MS8 and the center of gravity of the volume VS8 are arranged offset to one another relative to the longitudinal axis of the combined weapon clearance device 8 such that the front end of the combined weapon clearance device 8 is lowered to a considerable extent. Due to the lowered front end and the negative buoyancy of the combined weapon clearance device 8, the combined weapon clearance device 8 in the case of the failure of its drive would sink to the bottom of the body of water with the front end and/or with the weapon clearance device 10 at the front, ram the bottom of the body of water, release the retaining devices 22 and 24 at the same time and as a result cause a separation of the weapon clearance device 10 from the unmanned underwater vehicle 12. The unmanned underwater vehicle 12 would then rise to the surface of the body of water due to its positive buoyancy.

In the view according to FIG. 1, the oblique position of the combined weapon clearance device 8 is slightly steeper relative to the oblique position which would be set without driving the unmanned underwater vehicle 12, in order to be able to steer towards the mine 26 at an even steeper angle. This steeper oblique position is effected by means of the drive and/or the drives of the unmanned underwater vehicle 12 as well as by means of control devices of the unmanned underwater vehicle 12 counter to an aligning moment on the combined weapon clearance device 8.

Figure 2:
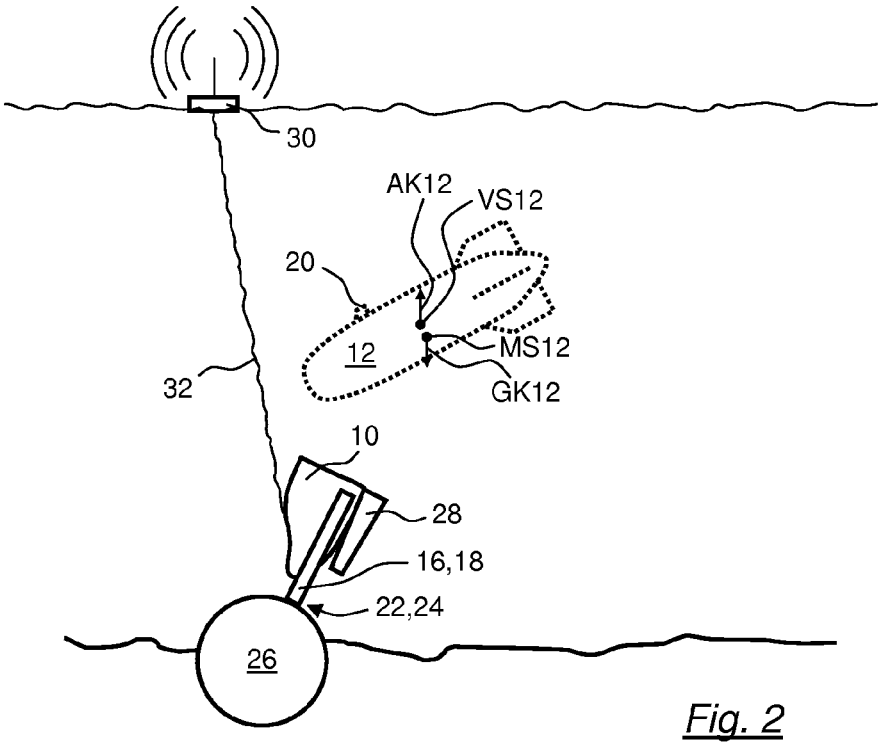
FIG. 2 shows the weapon clearance device according to FIG. 1 after the fixing thereof to the underwater mine as well as after separation from the unmanned underwater vehicle, in accordance with various embodiments of the present disclosure.

FIG. 2 shows the weapon clearance device 10 of FIG. 1 after activating the retaining devices 22 and 24 to attach the weapons clearance device to the mine 26.

The retaining devices 22 and 24 are either activated by contact of the weapon clearance device 10 with the mine 26, or already activated by the weapon clearance device 10 approaching the mine 26 to a significant extent. A metal sensor, for example, detects when the mine 26 is approached to a significant extent. The weapon clearance device 10 is securely fixed to the mine 26 by means of the retaining devices 22 and 24, e.g., by means of the nails of nail firing devices.

At the same time as the weapon clearance device 10 is fixed to the mine 26, the radio beacon 30 is released from the weapon clearance device 10 and a buoyancy body on the radio beacon 30 is activated, which ensures the buoyancy on the radio beacon 30. Alternatively, the radio beacon 30 already provides buoyancy itself, which is partially compensated or overcompensated by the remaining part of the weapon clearance device 10. Even when the radio beacon 30 is released from the weapon clearance device 10 and/or from the remaining devices of the weapon clearance device 10, the radio beacon 30 remains connected to transmit signals via a line 32 to a firing device and/or a spoof device of the weapon clearance device 10.

At the same time as the weapon clearance device 10 is fixed to the mine 26, or alternatively also subsequent to the fixing, the weapon clearance device 10 is released from the underwater vehicle 12 and the underwater vehicle 12 is moved away from the mine 26 to a distance which is greater than or the same as a pre-determined safety distance. Then the weapon clearance device 10 causes a detonation of the mine 26, by a clearance charge, for example in the form of the hollow charge 28, or the spoof device being activated, by means of which the presence of a ship and/or submarine is simulated to the mine 26. As a result of such a simulation, the separate firing mechanism is activated so that the mine 26 is detonated.

After releasing the weapon clearance device 10 from the unmanned underwater vehicle 12, the weapon clearance device 10 no longer pulls the unmanned underwater vehicle downwards, in particular the front end thereof, so that firstly the greater buoyancy force according to the buoyancy force vector AK12, relative to the weight force according to the weight force vector GK12, on the unmanned underwater vehicle 12, permits the unmanned underwater vehicle 12 as a whole to rise to the surface of the body of water and thus to be moved away from the weapon clearance device 10. Secondly, the center of gravity of the mass MS12 and the center of gravity of the volume VS12 of the unmanned underwater vehicle 12 relative to the longitudinal axis of the underwater vehicle 12 are arranged without displacement or with only a small degree of displacement relative to one another, so that a large aligning moment acts on the underwater vehicle 12, which permits the front end of the underwater vehicle 12 to be lifted from its lowered position until the longitudinal axis of the underwater vehicle 12 is arranged approximately horizontally and/or until the buoyancy vector AK12 and the weight force vector GK12 are arranged on a common vertical.

Due to the specific design of the weapon clearance device 10, the unmanned underwater vehicle 12 is thus able to move away particularly rapidly from the weapon clearance device 10 after the separation thereof from the weapon clearance device 10.

The integral units 16 and 18 comprise the means for the releasable connection of the weapon clearance device 10 to the underwater vehicle 12 and the retaining devices 22 and 24 for fixing the weapon clearance device 10 to a weapon. In addition to the elastic strap 14, the means for the releasable connection comprise retaining members which retain the elastic strap 14 via loops of the elastic strap 14.

The retaining devices 22 and 24 and/or the nail firing devices comprise cartridges for driving bolts as well as cartridge firing devices for firing the cartridges. The cartridge firing devices are fired, for example, upon contact of the weapon clearance device 10 with a weapon or a different object, or are triggered by means of a metal detector. The fired cartridges not only drive nails into the weapon 26 and thereby fasten the weapon clearance device 10 to the weapon 26. Additionally, at the same time the retaining members are released from the loops of the elastic strap 14 so that the elastic strap 14 is released and thus the weapon clearance device 10 is released from the unmanned underwater vehicle 12.

Figure 3:
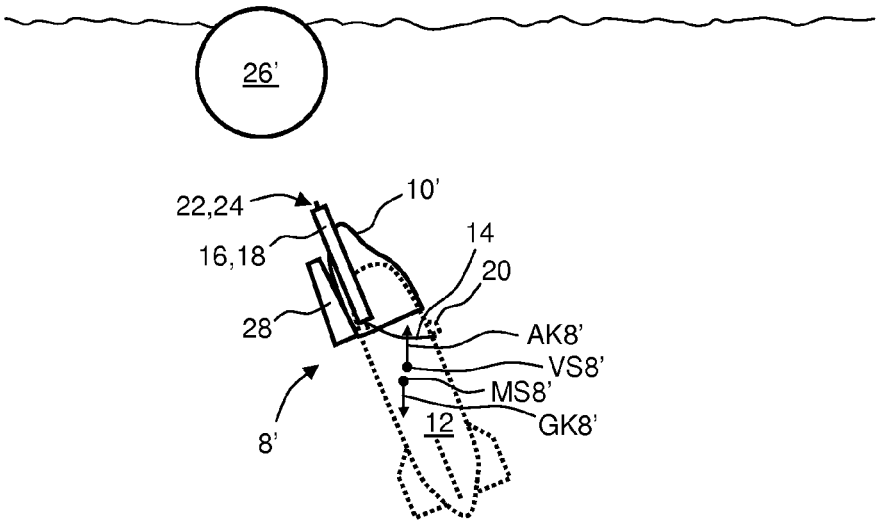
FIG. 3 shows the unmanned underwater vehicle according to FIG. 1 with the weapon clearance device attached thereto according to various other embodiments of the present disclosure when approaching an underwater mine configured as a floating mine.

FIG. 3 shows a combined weapon clearance device 8' with the unmanned underwater vehicle 12 according to FIG. 1, and with a weapon clearance device 10' which is particularly suitable for clearing a weapon and/or a mine 26', which is configured as a floating mine and/or floats on the surface of a body of water. The weapon clearance device 10' has a positive buoyancy which is greater than the similarly positive buoyancy of the unmanned underwater vehicle 12. Thus, the combined weapon clearance device 8' adopts an oblique position in the water with a raised front end of the combined weapon clearance device 8', even when the unmanned underwater vehicle 12 is not driven. The weapon clearance device 10' can therefore advantageously be moved from below by means of the unmanned underwater vehicle 12 towards the mine 26'. This has the advantage relative to an approach from the side that swell and waves are comparatively less able to interfere with the approach to the mine 26'. The probability that the weapon clearance device 10' is fastened accurately to the mine 26' is thus increased.

The center of gravity of the volume VS8' of the combined weapon clearance device 8' is displaced relative to the center of gravity of the mass MS8' of the combined weapon clearance device 8' relative to the longitudinal axis of the combined weapon clearance device 8' relative to the front end of the combined weapon clearance device 8'. As a result, an aligning moment is present which aims to arrange the center of gravity of the mass 8' directly below the center of gravity of the volume 8' and/or the buoyancy force vector AK8' and the weight force vector GK8' on a common vertical. Relative to the oblique position of the combined weapon clearance device 8' which is set by means of the aligning moment, the oblique position in the illustration according to FIG. 3 is increased further counter to an aligning moment by means of drives and/or control devices of the unmanned underwater vehicle 12, in order to maintain an even steeper angle of attack towards the mine 26'.

Figure 4:
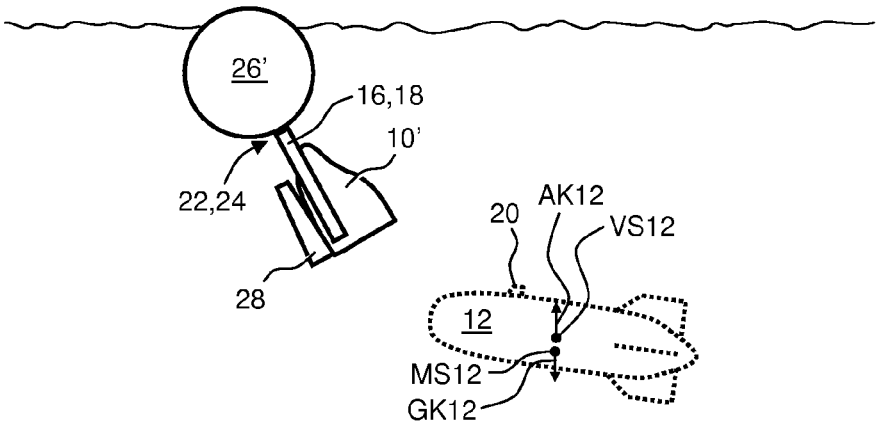
FIG. 4 shows the weapon clearance device according to FIG. 3 after the fixing thereof to the underwater mine as well as after the separation from the unmanned underwater vehicle, in accordance with various embodiments of the present disclosure.

FIG. 4 shows the combined weapon clearance device 8' with the weapon clearance device 10' of the various exemplary embodiments according to FIG. 3 after activating the retaining devices 22 and 24 on the mine 26'. An aligning moment on the unmanned underwater vehicle 12 causes the front end of the unmanned underwater vehicle 12 to be lowered and/or the rear end of the unmanned underwater vehicle 12 to be raised, the longitudinal axis of the unmanned underwater vehicle 12 being arranged substantially horizontally. Additionally, the drives of the unmanned underwater vehicle 12 effect a rearward thrust which rapidly moves the unmanned underwater vehicle away from the weapon clearance device 10' and thus, due to the initial oblique position of the unmanned underwater vehicle 12, initially effects a further submerging of the unmanned underwater vehicle 12 counter to the positive buoyancy of the unmanned underwater vehicle 12. In this case it can already be advantageous if when the combined weapon clearance device 8' approaches the mine 26' according to FIG. 3 a rearward thrust is produced which permits the weapon clearance device 10' to strike the mine 26' in a braked manner and which is sufficient to withdraw the unmanned underwater vehicle 12 from the cap-like weapon clearance device 10' immediately after release of the weapon clearance device 10' from the unmanned underwater vehicle 12.

Figure 5:
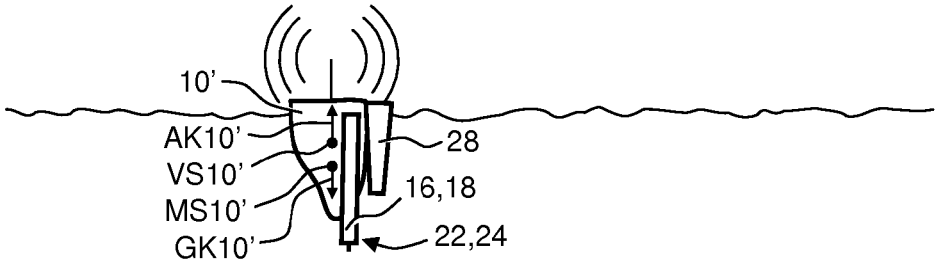
FIG. 5 shows the weapon clearance device according to FIG. 3 after the separation thereof from the unmanned underwater vehicle without being fixed to an underwater mine, in accordance with various embodiments of the present disclosure.

FIG. 5 shows the weapon clearance device 10' floating on the surface of a body of water. In particular, it can arise that the weapon clearance device 10' was not able to be fixed successfully to the mine 26' but has been released from the unmanned underwater vehicle 12, and therefore floats separately from the unmanned underwater vehicle 12 in the water. Also, it can arise that the weapon clearance device 10' is still initially fastened to the unmanned underwater vehicle 12, but the fixing of the weapon clearance device 10' to a mine is no longer possible as, for example, either it is no longer possible to release the means for fixing or the mine 26' can no longer be reached due to the weakening or already failed drive power on the unmanned underwater vehicle 12. In these cases the weapon clearance device 10' is released from the unmanned underwater vehicle 12, irrespective of whether the weapon clearance device 10' is fixed to a weapon. To this end, the weapon clearance device 10', for example, can receive an emitted signal via radio or via water-borne sound signals. Alternatively, the projection 20 of the underwater vehicle 12 could also be configured for an active release of the retaining rope 14.

After the release of the weapon clearance device 10' from the unmanned under-water vehicle 12, the weapon clearance device 10' floats due to its positive buoyancy on the surface of the body of water. The mass distribution on the weapon clearance device 10' is such that the center of gravity of the mass MS10' of the weapon clearance device 10 is displaced in the direction of the front end of the weapon clearance device 10 and/or in the active direction of the retaining devices 22 and 24 and/or in the firing direction of the nail firing devices relative to the center of gravity of the volume VS10' of the weapon clearance device 10'. As a result, the weapon clearance device 10' can, for example, approach a ship and collide with the ship even in the case where the means for fixing are still able to be activated and/or in the case where the nail firing device is still able to be triggered, without this leading to the fixing of the weapon clearance device 10' to the ship. The buoyancy force vector AK10' of the weapon clearance device 10' and the weight force vector GK10' of the weapon clearance device 10' are thus arranged on a common vertical which is located parallel to the firing direction of the nail firing device and to the active direction of the hollow charge 28.

An antenna can be provided on the weapon clearance device 10' as shown in FIG. 5, by means of which antenna signals can be transmitted for locating the weapon clearance device and/or control signals, in particular for releasing the retaining devices 22 and 24 and/or the hollow charge 28, can be received. The weapon clearance device 10' can thus be located and detonated when a danger to objects in the vicinity is excluded.

Alternatively, the weapon clearance device 10' can also be provided with the radio beacon 30 similar to the weapon clearance device 10 according to FIG. 1, and transmitting and/or receiving corresponding signals by means of the radio beacon 30, in particular after the deposit thereof.

Figure 6:
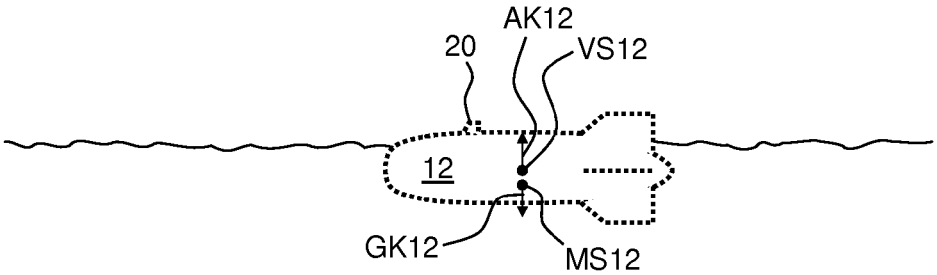
FIG. 6 shows the unmanned underwater vehicle according to FIGS. 1 to 5, after the malfunction of its drive and separation from the weapon clearance device, floating on the surface of the body of water, in accordance with various embodiments of the present disclosure.

FIG. 6 shows the unmanned underwater vehicle 12 according to FIGS. 1 to 4 after the separation of the weapon clearance device 10, 10' from the unmanned underwater vehicle 12 and in the case of failure of the drives of the unmanned underwater vehicle 12. In this case, the unmanned underwater vehicle 12 rises to the surface of the body of water and floats there with a substantially horizontal alignment of its longitudinal axis in the water. The center of gravity of the mass MS12 is arranged below the center of gravity of the volume VS12 such that not only a pitching movement and/or overturning about the transverse axis of the underwater vehicle 12 is counteracted but also a rotation about the longitudinal axis of the underwater vehicle 12. The underwater vehicle 12 is, therefore, located in a stable manner in the water and can optionally be captured and, after maintenance and/or after charging its batteries, can be reused in combination with a further weapon clearance device.

Overall, therefore, the invention permits the cost-effective clearance, in particular, of mines which are not easily accessible, which are partially buried in the bottom of the body of water or which float on the surface of the body of water. Even with such mines in which an approach from the side is not possible or is at least difficult, the invention is able to attach the driveless weapon clearance device 10 and/or 10' accurately and thus detonate the mine. The weapon clearance device 10 and/or 10' which is cost-effective due to its driveless design as an attachment is destroyed during the clearance of the mine. The unmanned underwater vehicle 12 serving as a transport vehicle which is relatively expensive, however, can be salvaged and employed for further uses.

All of the features cited in the above description and in the claims are able to be used individually or in any combination with one another. The disclosure of the invention is thus not limited to the disclosed and/or claimed combination of features. Instead, all combinations of features are to be considered as disclosed. That is, the description herein is merely exemplary in nature and, thus, variations that do not depart from the gist of that which is described are intended to be within the scope of the teachings. Such variations are not to be regarded as a departure from the spirit and scope of the teachings.

What is claimed is:

1. A combined weapon clearance device for clearing weapons under water by detonating the weapon, comprising an unmanned underwater vehicle and a weapon clearance device that is attachable thereto, wherein the weapon clearance device comprises:

a retaining device for one of:

fixing the weapon clearance device to the weapon, and retaining the weapon clearance device in close proximity to the weapon in an area surrounding the weapon, wherein the weapon clearance device is a driveless attachment for an unmanned underwater vehicle; and a releasable connection means for releasably securing the weapon clearance device to the unmanned underwater vehicle, wherein the weapon clearance device has one of a positive buoyancy and a negative buoyancy, and wherein, when the weapon clearance device has a positive buoyancy, the unmanned underwater vehicle has one of a lower positive buoyance than the weapon clearance device, a neutral buoyancy and a negative buoyancy, and when the weapon clearance device has a negative buoyancy, the unmanned water vehicle has one of a smaller negative buoyancy than the weapon clearance device, a neutral buoyancy and a positive buoyancy, such that an overturning moment is produced about a transverse axis of the combined weapon clearance device.

2. The combined weapon clearance device according to claim 1, wherein the weapon clearance device comprises at least one clearance charge with directional effect and a firing device for firing the clearance charges.

3. The combined weapon clearance device according to claim 2, wherein the weapon clearance device comprises a spoof device for simulating properties of at least one of a ship and a submarine, the spoof device comprising at least one of:

a means for producing noise of the at least one of a ship and a submarine; and a means for producing a magnetic field.

4. The combined weapon clearance device according to claim 3, comprising at least one of a means for activating the firing device and a means for activating the spoof device.

5. The combined weapon clearance device according to claim 4, wherein the means for activating at least one of the firing device and the spoof device comprise at least one of:

a radio beacon that can be released from the weapon clearance device for receiving an activation signal via a radio link;

an electroacoustic transducer for receiving an activation signal via an acoustic channel;

a firing cable for receiving an activation signal via the firing cable; and a timed firing mechanism.

6. The combined weapon clearance device according to claim 5, wherein the retaining device comprises at least one of:

a nail firing device;

an electromagnet;

a vacuum device; and a clamping device for clamping the weapon clearance device to at least one of:

the weapon;

parts of the weapon; and objects in the surrounding area of the weapon.

7. The combined weapon clearance device according to claim 6, wherein the means for the releasable connection of the weapon clearance device to the unmanned underwater vehicle structured and operable to:

be actuated simultaneously with activation of the retaining device for one of fixing the weapon clearance device to one of the weapon, and retaining the weapon clearance device in close proximity to the weapon in an area surrounding the weapon; and be actuated independently of activation of the retaining device, in order to release the weapon clearance device from the unmanned underwater vehicle.

8. The combined weapon clearance device according to claim 7, wherein the center of gravity of the mass of the weapon clearance device is displaced relative to the center of gravity of the volume of the weapon clearance device in the active direction of the retaining device in particular in the firing direction of the nail firing device.

9. The combined weapon clearance device according to claim 8, wherein the center of gravity of the mass of the weapon clearance device relative to the center of gravity of the volume of the weapon clearance device is displaced to one side of the weapon clearance device and which, in the case where the weapon clearance device is attached to the unmanned underwater vehicle, is remote from the center of gravity of the mass of the underwater vehicle.

10. A method for clearing weapons under water by detonating the weapon utilizing a combined weapon clearance device comprising an unmanned underwater vehicle having a weapon clearance device removably attached thereto, the weapon clearance device comprising:

a retaining device for fixing the weapon clearance device to one of:

the weapon; and an area surrounding and in close proximity the weapon, wherein the weapon clearance device is a driveless attachment for an unmanned underwater vehicle; and a releasable connection means for releasably securing the weapon clearance device to the unmanned underwater vehicle, wherein the weapon clearance device has one of a positive buoyancy and a negative buoyancy, said method comprising:

one of fixing the weapon clearance device to the weapon, and retaining the weapon clearance device in close proximity to the weapon in an area surrounding the weapon, wherein:

when the buoyancy of the weapon clearance device is positive, the unmanned underwater vehicle has one of a lower positive buoyancy than the weapon clearance device, a neutral buoyancy and a negative buoyancy such that an overturning moment is produced about a transverse axis of the combined weapon clearance device, and the unmanned underwater vehicle approaches the weapon from below with the front end raised, and when the buoyancy of the weapon clearance device is negative, the unmanned water vehicle has one of a smaller negative buoyancy than the weapon clearance device, a neutral buoyancy and a positive buoyancy, such that an overturning moment is produced about a transverse axis of the combined weapon clearance device, and the unmanned underwater vehicle approaches the weapon from above with the front end lowered;

releasing the weapon clearance device from the unmanned underwater vehicle;

in response thereto, automatically moving the unmanned underwater vehicle away from the weapon and altering its alignment in the water, the unmanned underwater vehicle being moved away from the weapon to a distance corresponding at least to a predetermined safety distance; and activating at least one of a clearance charge and spoof device of the weapon clearance device in order to detonate the weapon.

11. The method according to claim 10, wherein when fixing the weapon clearance device to the one of the weapon and in the surrounding area of the weapon is interrupted, the unmanned underwater vehicle automatically sinks with the weapon clearance device attached thereto, as the mass of the underwater vehicle together with the mass of the weapon clearance device is greater than the mass of the water displaced by the underwater vehicle together with the weapon clearance device under water, the method further comprises:

automatically releasing the weapon clearance device at the bottom of the body of water from the unmanned underwater vehicle in response to ground contact of the weapon clearance device, whereafter the unmanned underwater vehicle automatically rises to the water surface, as the mass of the unmanned underwater vehicle is less than the mass of the water displaced by the unmanned underwater vehicle under water.

12. The method according to claim 10, wherein, the center of gravity of the mass of the weapon clearance device is displaced relative to the center of gravity of the volume of the weapon clearance device in the active direction of the retaining device in particular in the firing direction of the nail firing device, and wherein when fixing the weapon clearance device to the one of the weapon and in the surrounding area of the weapon is interrupted, the method further comprises:

releasing the weapon clearance device from the unmanned underwater vehicle, whereafter the unmanned underwater vehicle automatically rises to the surface of the body of water, and separately therefrom the weapon clearance device rises to the surface of the body of water and subsequently floats there in an alignment with a reduced active direction of the retaining device.

* * * * *